US012582237B1

(12) United States Patent
Claffy

(10) Patent No.: US 12,582,237 B1
(45) Date of Patent: Mar. 24, 2026

(54) ROTATIONALLY-MOLDED WALL BUNK

(71) Applicant: Correctional Technologies, Inc., Willowbrook, IL (US)

(72) Inventor: Joseph R. Claffy, Western Springs, IL (US)

(73) Assignee: Correctional Technologies, Inc., Willowbrook, IL (US)

( * ) Notice: Subject to any disclaimer, the term of this patent is extended or adjusted under 35 U.S.C. 154(b) by 8 days.

(21) Appl. No.: 18/893,572

(22) Filed: Sep. 23, 2024

(51) Int. Cl.
*A47C 21/08* (2006.01)
*A47C 17/50* (2006.01)
*A47C 19/02* (2006.01)

(52) U.S. Cl.
CPC ..... *A47C 17/50* (2013.01); *A47C 19/02* (2013.01)

(58) Field of Classification Search
CPC ..... A47C 17/50; A47C 17/46; A47C 19/02; A47C 19/20; A47C 20/023; A47C 21/08
See application file for complete search history.

(56) References Cited

U.S. PATENT DOCUMENTS 3,656,193 A * 4/1972 Schneider ..... A47D 5/00 206/823
4,413,367 A * 11/1983 Miller ..... A47C 27/085 5/915
5,335,385 A * 8/1994 Brown ..... A47C 21/08 5/503.1
5,875,502 A * 3/1999 Kolbenstetter ..... A47C 17/42 5/9.1
6,058,531 A * 5/2000 Carroll ..... A61G 7/0513 5/430
6,715,170 B2 * 4/2004 Richmond ..... A61G 1/00 5/628
8,042,700 B1 * 10/2011 Smalley ..... A47F 5/0807 211/90.01
2009/0307838 A1 * 12/2009 Claffy ..... A47C 19/202 5/8
2011/0296610 A1 * 12/2011 Moon ..... A47C 19/025 5/308

(Continued)

OTHER PUBLICATIONS

Cortech, Endurance Wall Mount Bunk Drop Test, Aug. 8, 2019, YouTube, https://www.youtube.com/watch?v=SrcQKkpVTeQ.*

(Continued)

*Primary Examiner* — Justin C Mikowski
*Assistant Examiner* — Ifeolu A Adeboyejo
(74) *Attorney, Agent, or Firm* — Fitch, Even, Tabin & Flannery LLP

(57) ABSTRACT

In one aspect, a wall bunk is provided that includes a rotationally molded body having an overall length, a mounting portion of the body, and an elongate bed pan. The bed pan has a lower wall including a mattress support surface and a front wall. The lower wall includes curved wall portions at internal kiss-offs of the body. The mattress support surface has recesses defined at least in part by the curved wall portions for collecting moisture. The wall bunk further includes a rail configured to be connected to the front wall of the bed pan. With the rail connected to the front wall, the front wall has an uncovered portion with a length that is at least forty percent of the overall length of the body to provide a lateral opening for ingress and egress relative to the wall bunk.

14 Claims, 16 Drawing Sheets

(56) References Cited

U.S. PATENT DOCUMENTS

| | | | | |
|---|---|---|---|---|
| 2013/0061395 | A1* | 3/2013 | Karl | A47C 31/02 5/503.1 |
| 2020/0037774 | A1* | 2/2020 | Moon | A47C 19/20 |
| 2021/0337975 | A1* | 11/2021 | Drever | A47C 20/043 |

OTHER PUBLICATIONS

MaxSecure Systems Inc., Max-Secure Institutional Furniture, Endura Series Bunk Bed EN 6000—20 catalog, publicly available as early as Dec. 2018.
Cortech Corrections Catalog 2024, publicly available before Sep. 23, 2024, 27 pages.
Images and description of a wall bunk sold on Aug. 1, 2023, 2 pages.

* cited by examiner

ROTATIONALLY-MOLDED WALL BUNK

TECHNICAL FIELD

This disclosure relates generally to rotationally-molded furniture and, more specifically, relates to rotationally-molded wall bunks.

BACKGROUND

Rotationally-molded furniture may be used in correctional, mental health, and behavioral health facilities. Wall bunks are one type of rotationally-molded furniture that may be used in correctional facilities. A wall bunk is typically mounted to a wall at an elevated position, such as up to six feet above the floor, and has a bed pan that receives a mattress.

One issue with rotationally-molded wall bunks used in correctional facilities is that moisture, such as sweat and urine, may accumulate in the bed pan underneath the mattress. One prior rotationally-molded wall bunk has 24 narrow, obround slots in the bed pan formed at kiss-offs in the material of the wall bunk. The narrow, obround slots could make it difficult in some circumstances to clean the bed pan. For example, some moisture may remain in the narrow, obround slots even after the bed pan is wiped down. Additionally, the wall bunk has groupings of the narrow-obround slots near the wall to which the wall bunk is mounted, which may be difficult to clean given the height of the wall bunk.

DETAILED DESCRIPTION

Figure 1:
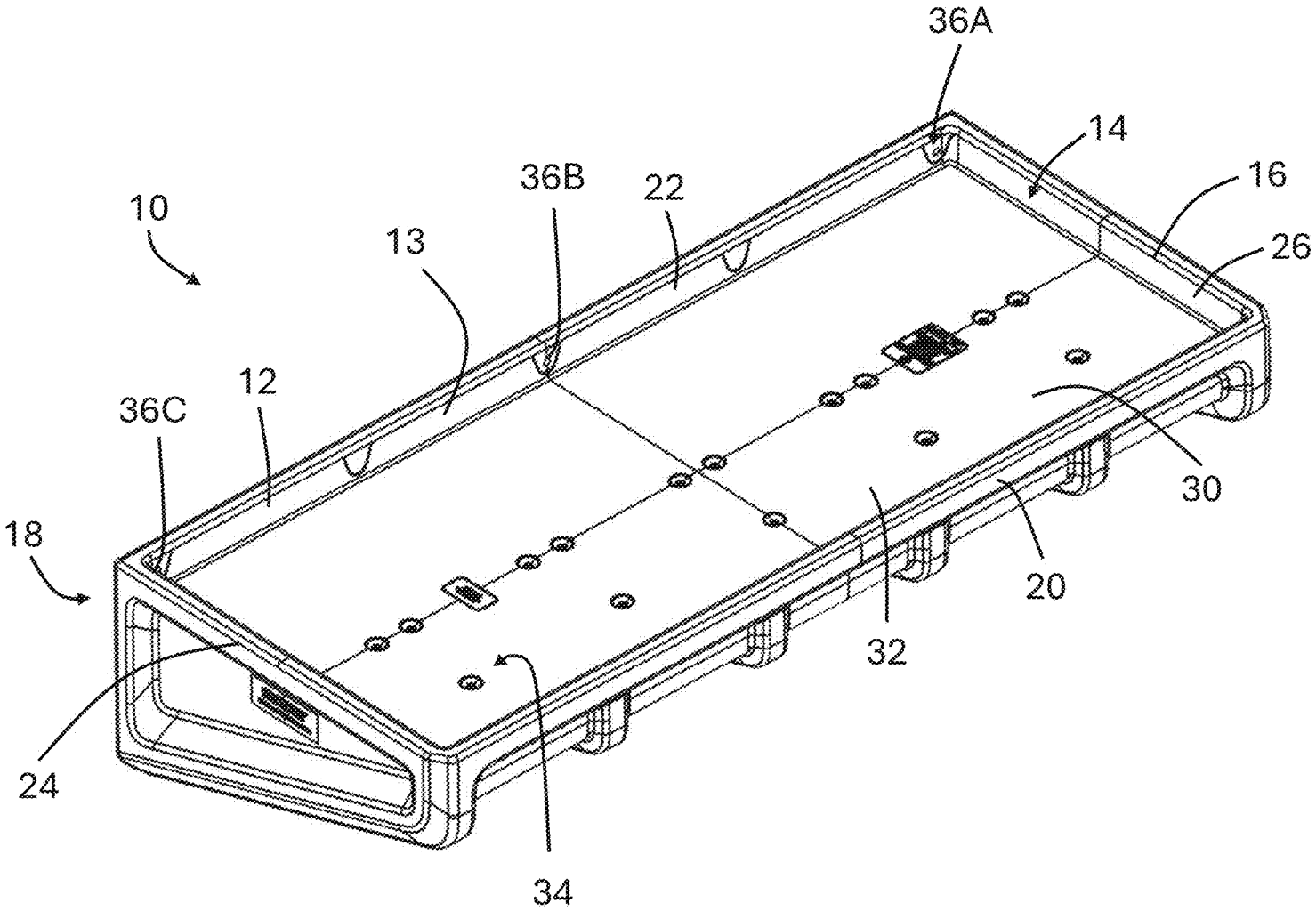
FIG. 1 is a perspective view of a wall bunk.

Regarding FIG. 1, a bed such as a wall bunk 10 is provided. The wall bunk 10 has a body 12 that is rotationally molded and has a unitary, one-piece construction. The rotational molding of the body 12 provides an exterior 13 made of a molded material, such as plastic, and a void or interior 14 (see FIG. 4) that may be filled with air, structural foam, or another material. In one embodiment, the body 12 is rotationally molded high-impact polyethylene and the interior 14 is contains air.

The exterior 13 of the wall bunk 10 has exposed outer surfaces 15 that are ligature resistant. More specifically, the outer surfaces 15 accessible by a user lack sharp corners, sharp edges, through openings, or posts that a user could use to injure themselves with. For example, the outer surfaces 15 lack features that a cord, rope, or other material can be tied around or leveraged by a user to injure themselves.

With continued reference to FIG. 1, the body 12 has a bed pan 14 has an upper opening 16 to receive a mattress 17 (see FIG. 4) and a wall mounting portion 18 for receiving anchors to secure the wall bunk 10 to a wall. The bed pan 14 includes a front wall 20, a rear wall 22, and end walls 24, 26. The bed pan 14 further includes a lower wall 30 with a support surface 32 for supporting an underside of the mattress 17. The support surface 32 includes recesses 34 for collecting moisture such as sweat and urine. The wall mounting portion 18 includes mounting holes such as three upper mounting holes 36A, 36B, 36C and three lower mounting holes 38A, 38B, 38C (see FIG. 7).

Figure 2:
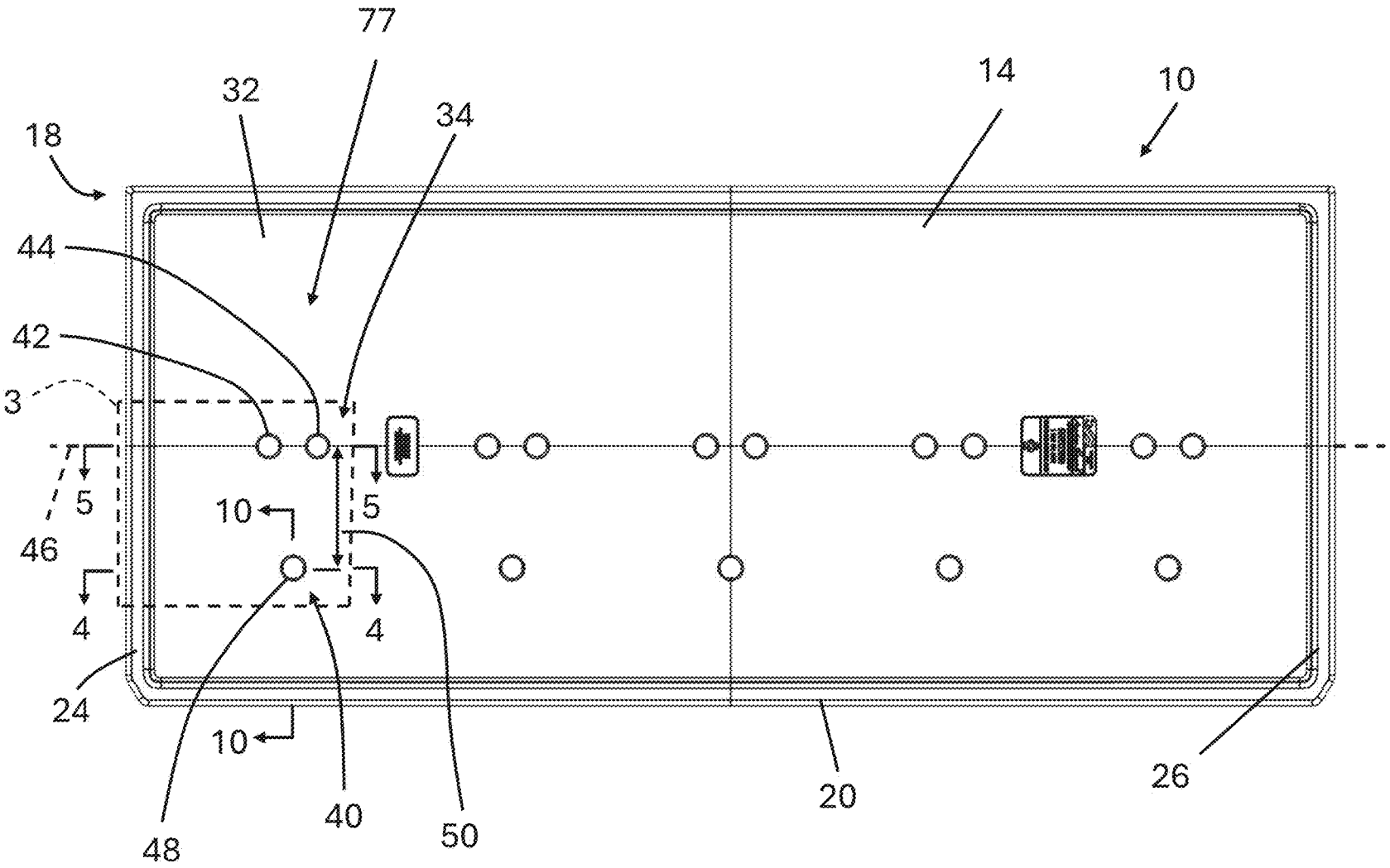
FIG. 2 is a top plan view of the wall bunk of FIG. 1 showing recesses in a bed pan of the wall bunk.

Regarding FIG. 2, the recesses 34 include a plurality of groupings 40 of the recesses 34. The groupings 40 each include two recesses 42, 44 bisected by a central longitudinal axis 46 of the bed pan 14 and a recess 48 laterally offset a distance 50 toward the front wall 20 from the central longitudinal axis 46.

Figure 3:
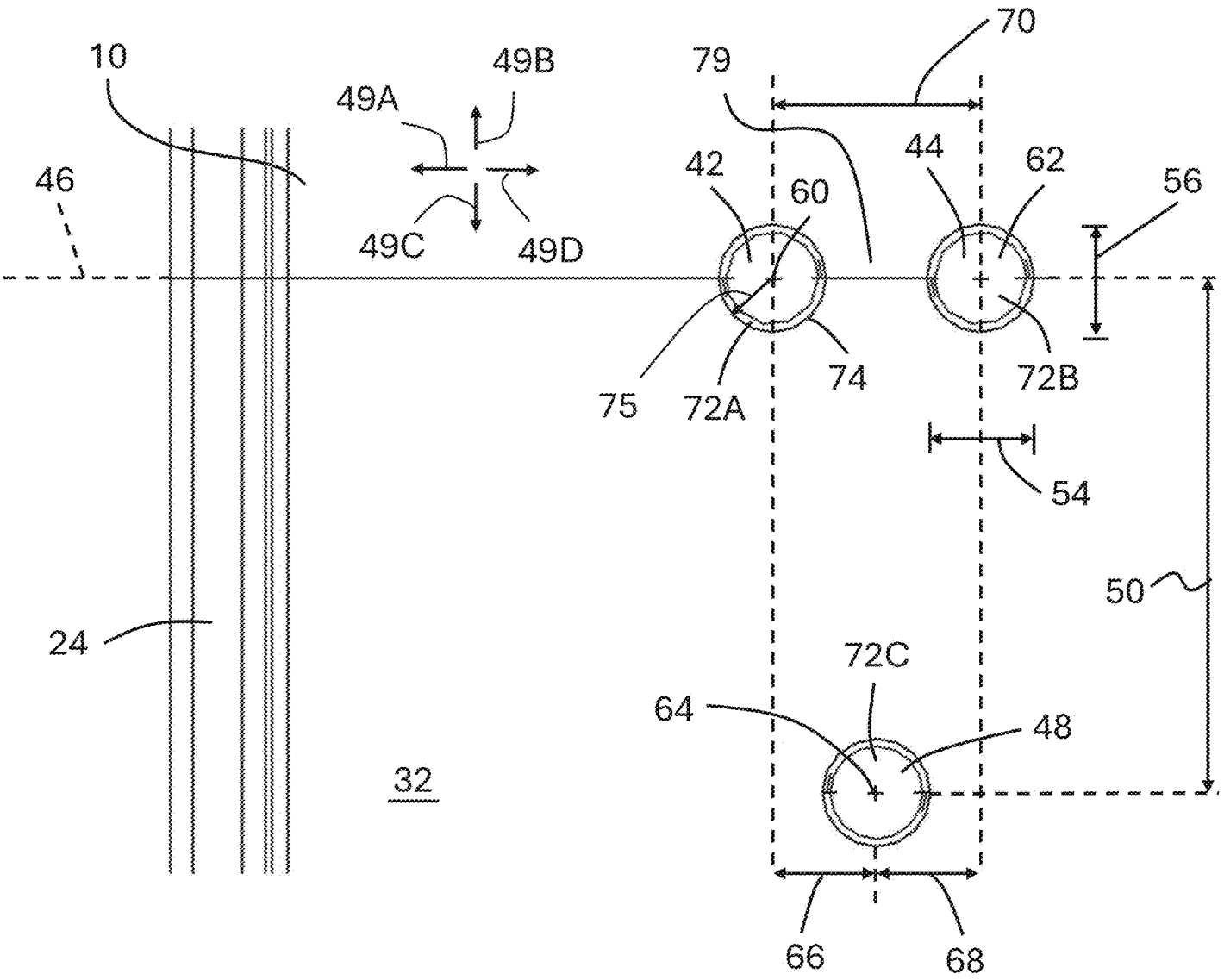
FIG. 3 is an enlarged view of the area shown in the dashed rectangle of FIG. 2.

Regarding FIG. 3, the recesses 42, 44, 48 each have a length 54 along the central longitudinal axis 46 and a width 56 perpendicular to the length 54. The width 56 is at least 50% of the length 54, such as 75% or 100% of the length 54. In one embodiment, the recesses 42, 44, 48 are circular and each have a center 60, 62, 64. The recesses 42, 44, 48 each have a concave surface 72A, 72B, 72C that curves inwardly from a circular edge or circular juncture 74 with the substantially flat support surface 32. The circular junctures 74 have a similar radius of curvature 75.

Figure 10:
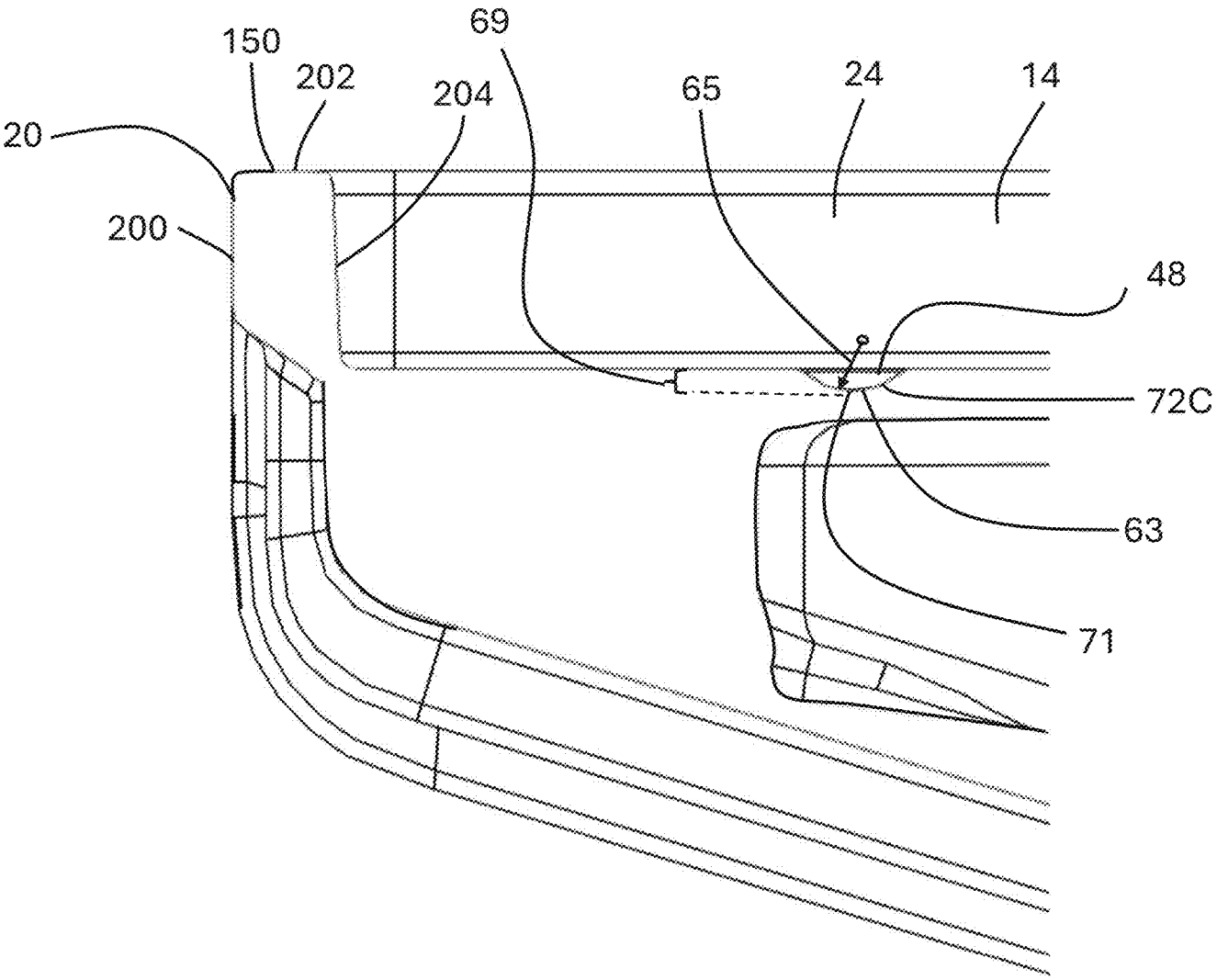
FIG. 10 is a cross-sectional view taken across line 10-10 in FIG. 2 showing a side wall of the bed pan that includes the rail mounting portion of the wall bunk of FIG. 1.

Regarding FIG. 10, the concave surfaces 72A, 72B, 72C each have a radius of curvature 65 that is larger than the radius of curvature 75 (see FIG. 3) of the circular juncture 74. The concave surfaces 72A, 72B, 72C extend inwardly to a lowermost surface portion 63 at a depth 69. The depth 69 is less than the radius of curvature 75 of the circular juncture 74 and is less than the radius of curvature 65 of the concave surfaces 72A, 72B, 72C. The wide, shallow recesses 42, 44, 48 permit a portion of a cleaning member, such as a rag, sponge, or brush, to extend into the recesses 42, 44, 48 all the way to a bottom 71 of the recesses 42, 44, 48 and clean out the recesses 42, 44, 48 as the cleaning member is moved across the support surface 32 in directions parallel to the support surface 32, such as in directions 49A-49D (see FIG. 3). Further, the wide circular shape of the recesses 42, 44, 48 are free of narrow areas that capture moisture and debris that inhibit complete cleaning of the bed pan 14. A person cleaning the bed pan 14 may thereby readily remove moisture and debris, such as dirt, from the recesses 42, 44, 48 by wiping down the bed pan 14 without having to force the cleaning member into narrow slots of the bed pan to remove moisture and debris from the narrow slots.

Returning to FIG. 3, the center 64 of recess 48 is positioned longitudinally between the centers 60, 62 of the recesses 42, 44, longitudinally offset by distances 66, 68 from the centers 60, 62, and laterally offset from the central longitudinal axis 46 by distance 50. Regarding FIG. 2, the support surface 32 of the bed pan 14 has a recess-free area 77 extending laterally from the recesses 42, 44 and the central longitudinal axis 46 to the rear wall 22. The absence of recesses in the area 77 limits moisture from being collected in the bed pan 14 near the wall to which the wall bunk 10 is mounted. The absence of recesses in the area 77 thereby makes it easier to wipe down the bed pan 14 even if the wall bunk 10 is installed at a relatively high height. Moisture that contacts the area 77 of the support surface 32 may be directed by a slight incline of the support surface 32 toward the recesses 42, 44, 48.

The centers 60, 62 of the recesses 42, 44 are spaced longitudinally by a distance 70 that may be greater than 1.5 times, such as two times, the length 54 of each recess 42, 44 to provide a spacing 79 through which moisture may travel toward the recess 48. Moisture from area 77 that travels past the recesses 42, 44 can be collected in the recess 48, which is closer to the bed pan front wall 20 and is easier to clean out.

Figure 4:
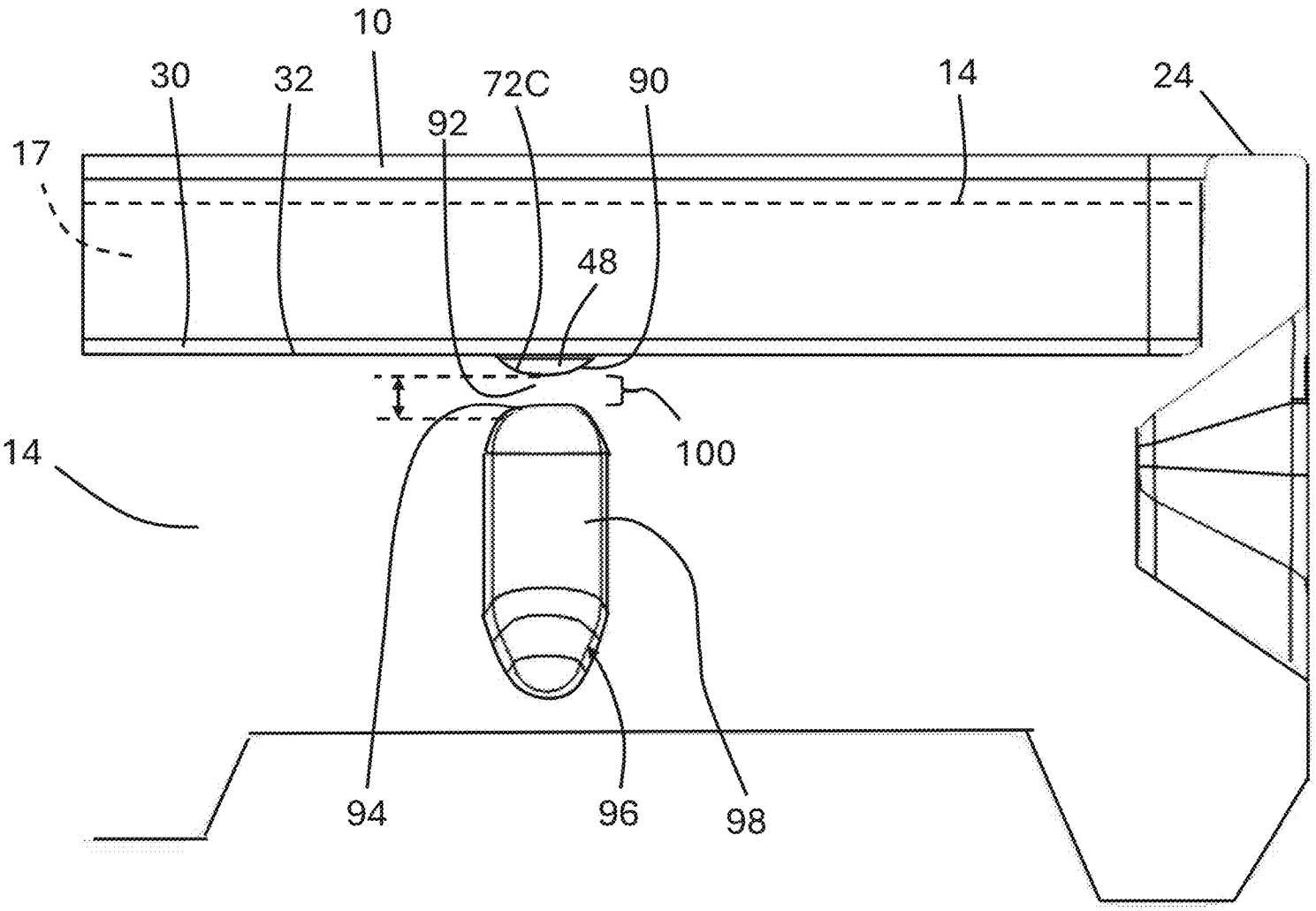
FIG. 4 is a cross-sectional view taken across line 4-4 showing one of the recesses at a kiss-off between a curved wall portion of the recess and an upper wall portion of an end portion of a compartment of the wall bunk.

Regarding FIG. 4, the lower wall 30 of the bed pan 14 includes a curved wall portion 90 having the concave surface 72C thereon. The curved wall portion 90 connects, via a kiss-off 92, with an upper wall portion 94 of an end portion 98 of compartment 96 of the wall bunk 10. The kiss-off 92 provides a portion 100 of solid body material, e.g., plastic, that provides rigidity to the wall bunk 10 and resists warpage of the support surface 32 during rotational molding of the wall bunk 10. Away from the kiss-off 92, the wall bunk body 12 is hollow and includes the interior 14 that may be filled with air or structural foam as discussed above.

Figure 5:
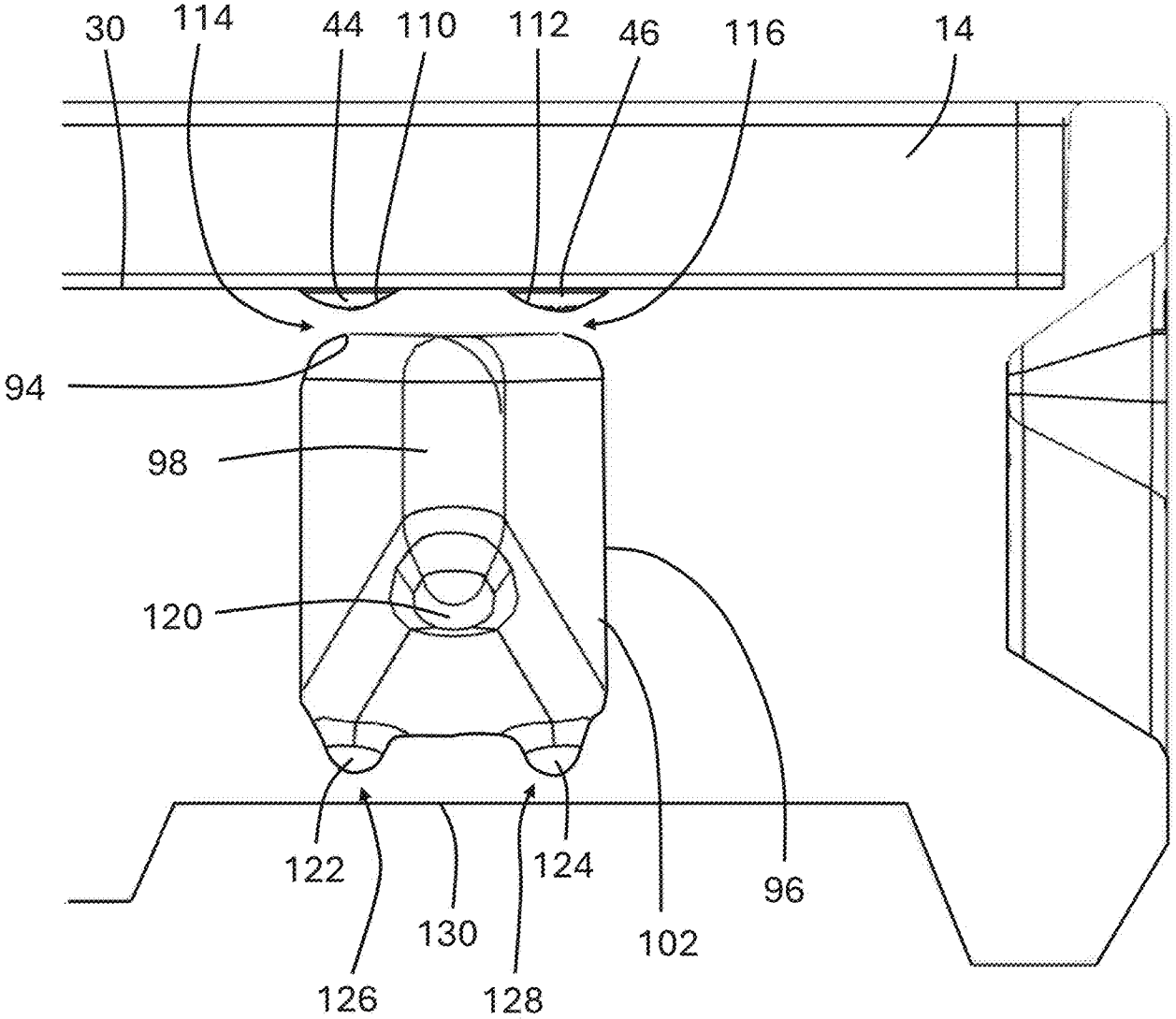
FIG. 5 is a cross-sectional view taken across line 5-5 in FIG. 2 showing recesses at kiss-offs between curved wall portions of the recesses and an upper wall portion of an intermediate portion of the compartment.

Regarding FIG. 5, a cross-sectional view is taken closer to the wall mounting portion 18 than the cross-sectional view of FIG. 4 such that an intermediate portion 102 of the compartment 96 is shown. The lower wall 30 of the bed pan 14 has curved wall portions 110, 112 that define the recesses 44, 42. The curved wall portions 110, 112 form kiss-offs 114, 116 with the upper wall portion 94 of the compartment 96. The compartment 96 includes recesses 120, 122, 124 that form kiss-offs 126, 128 with a lower wall portion 130 of the body 12 to provide rigidity to a lower portion of the wall bunk 10.

Figure 6:
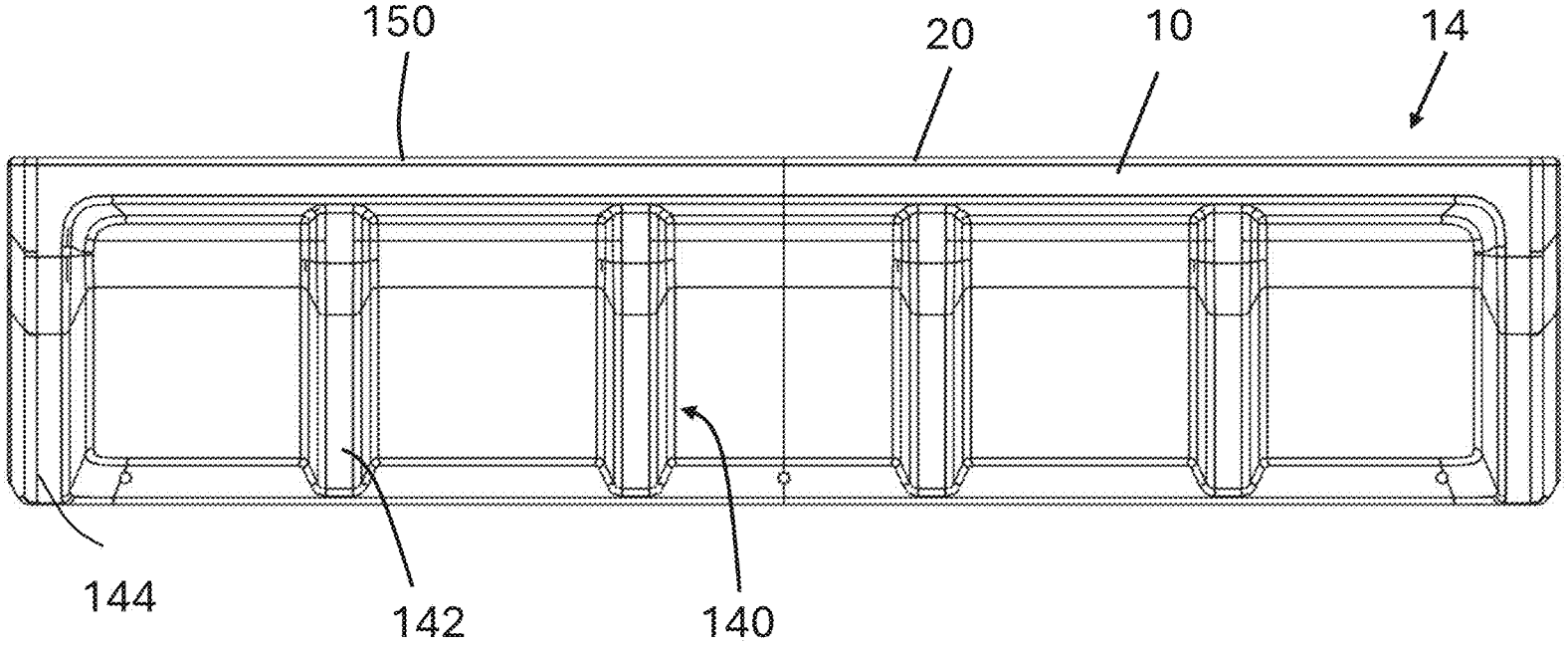
FIG. 6 is a front elevational view of the wall bunk of FIG. 1 showing an upper rail mounting portion of the wall bunk.

Regarding FIG. 6, the wall bunk 10 has ridges or ribs 140 that strengthen the wall bunk 10. The ribs 140 include a rib 142 and an end rib 144. The side wall 20 of the bed pan 14 includes a rail mounting portion 150 to receive a bed rail of a desired length as discussed in greater detail below.

Figure 7:
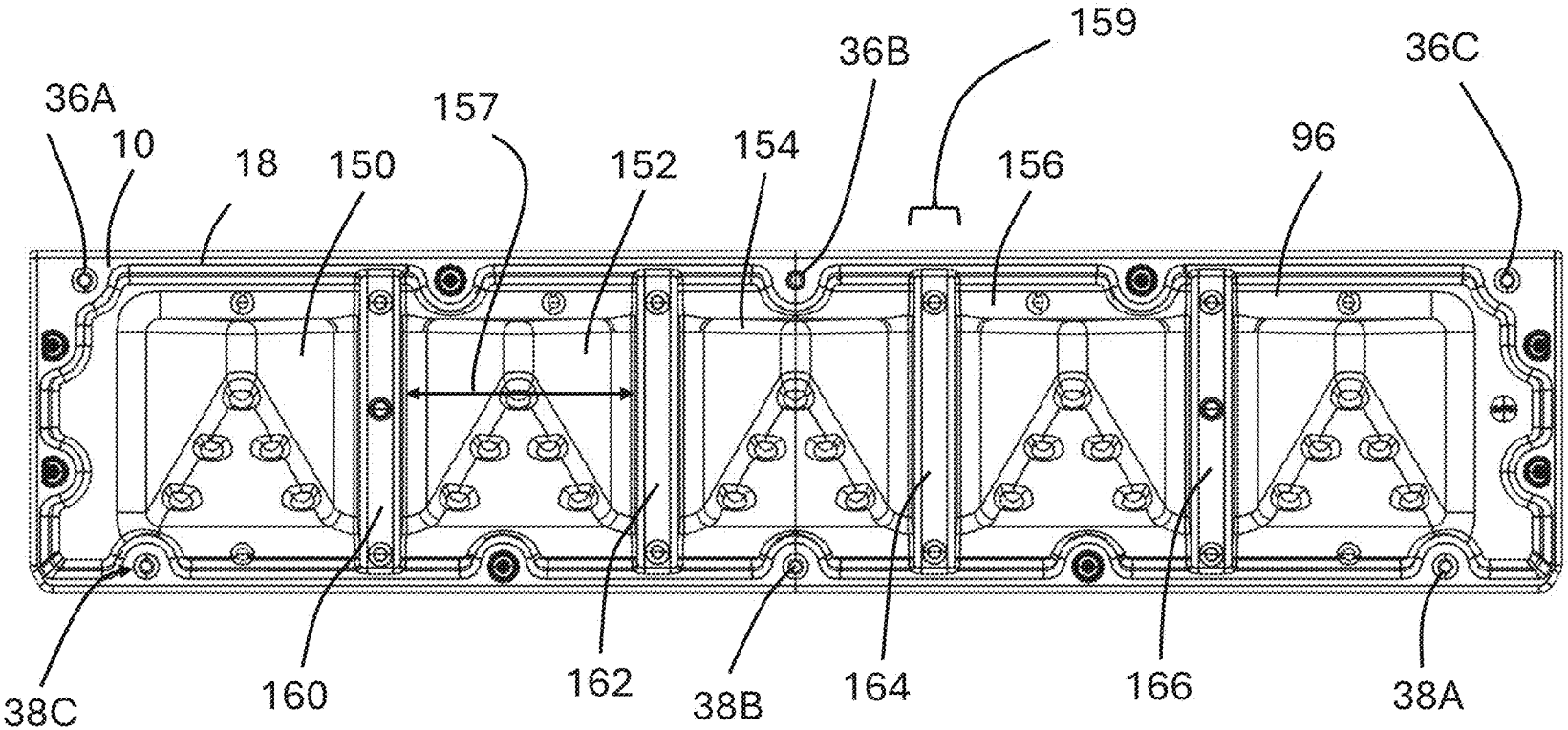
FIG. 7 is a rear elevational view of the wall bunk of FIG. 1 showing compartments of the wall bunk and divider walls between compartments.

Regarding FIG. 7, a rear elevational view of the wall bunk 10 is provided. The wall bunk 10 has internal compartments 150, 152, 154, 156 and divider walls 160, 162, 164, 166 that strengthen the wall bunk 10. The compartments 150, 152, 154, 156 each have a width 157 that decreases as the compartments 150, 152, 154, 156 extend into the page in FIG. 7 because the divider walls 160, 162, 164, 166 have a thickness 159 that increases as the divider walls 160, 162, 164, 166 extend into the page in FIG. 7. The increasing thickness 159 of the divider walls 160, 162, 164, 166 provides more body material (e.g. plastic) along the wall bunk 10 as the wall bunk 10 extends away from the mounting portion 18 to strengthen the wall bunk 10.

Figure 8:
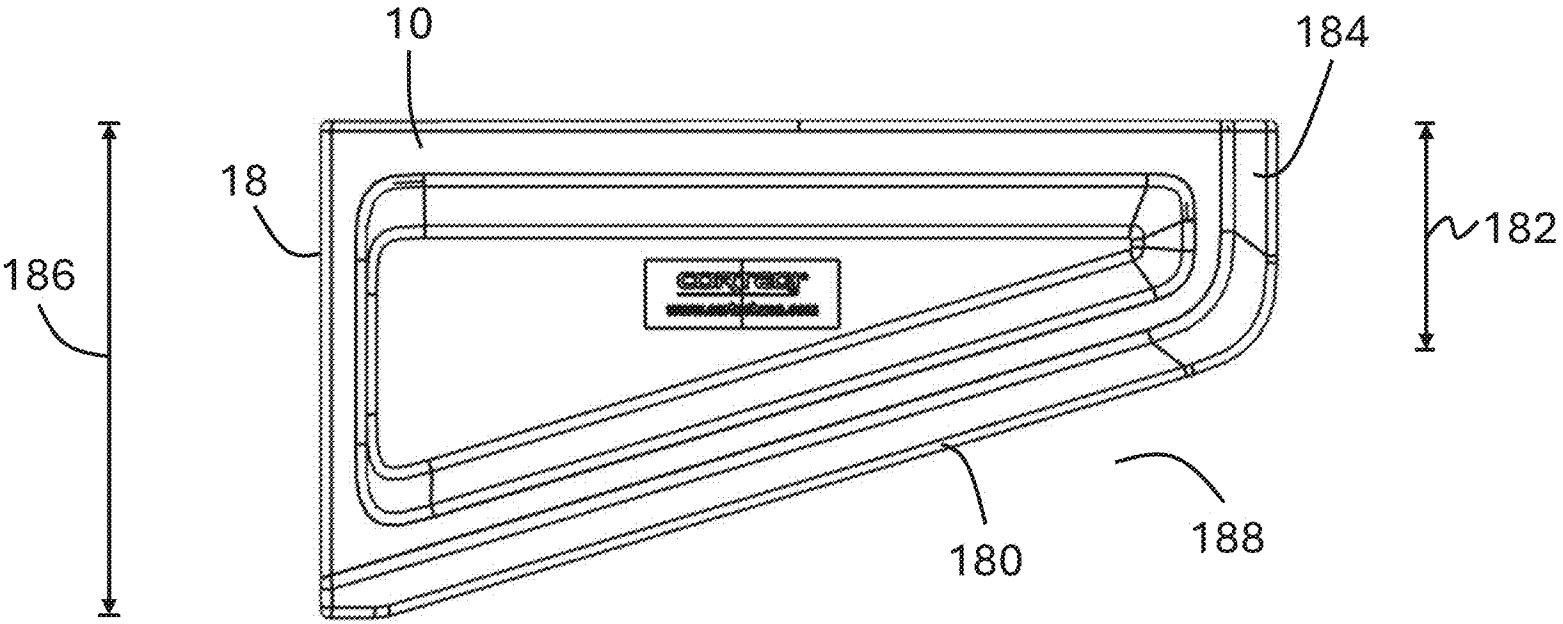
FIG. 8 is an end elevational view of the wall bunk of FIG. 1.

Regarding FIG. 8, the wall bunk 10 has a tapered lower portion 180 that is angled to provide a height 182 of an outboard portion 184 of the wall bunk 10 that is less than a height 186 of the wall bunk 10 at the wall mounting portion 18. The tapered lower portion 180 also provides a recess 188 for clearance below the wall bunk 10.

Figure 9:
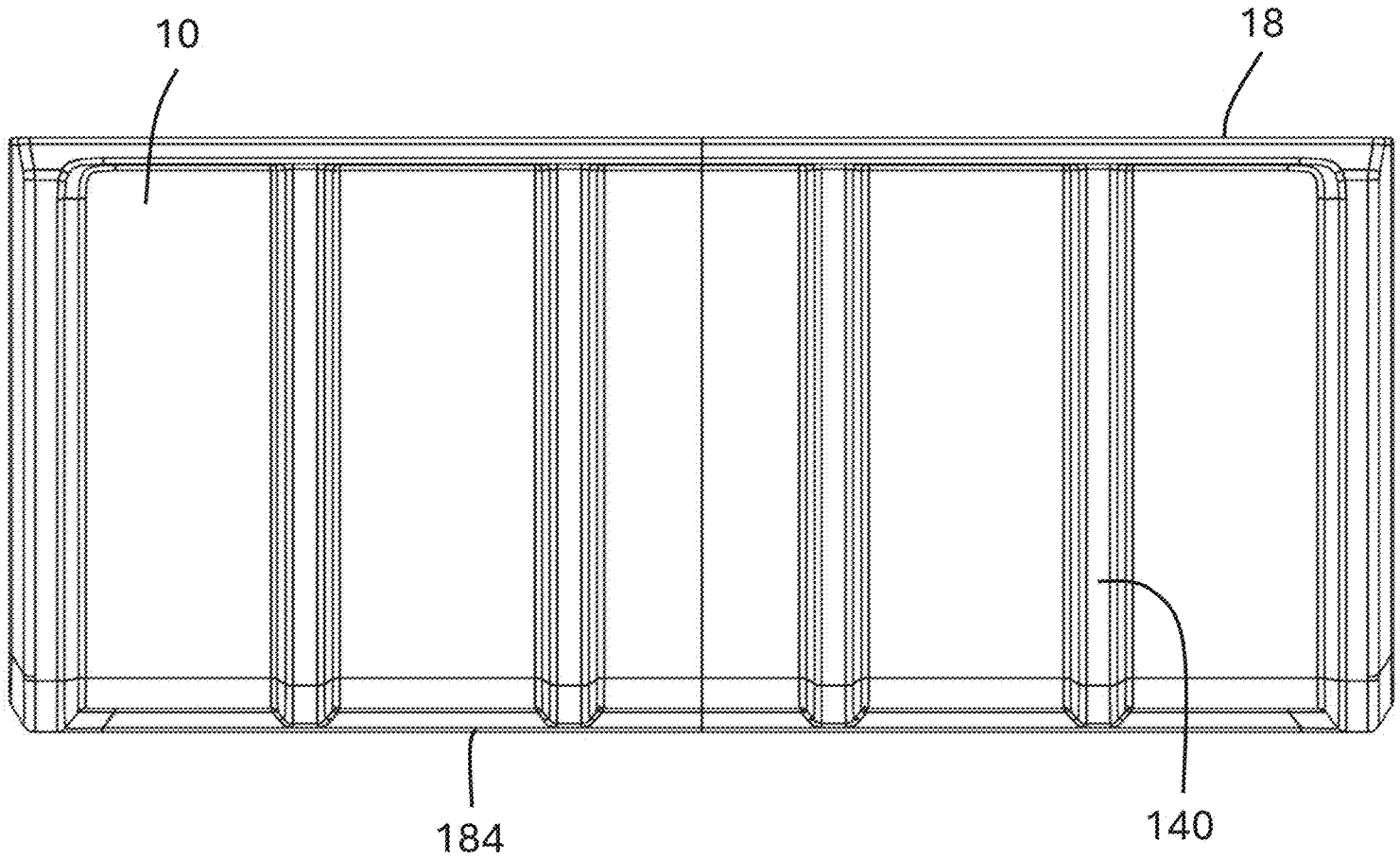
FIG. 9 is a bottom plan view of the wall bunk of FIG. 1 showing strengthening ribs extending along an underside of the wall bunk.

Regarding FIG. 9, a bottom plan view of the wall bunk 10 is provided. The ribs 140 extend from the wall mounting portion 18 to the outboard portion 184 to strengthen the underside of the wall bunk 10.

Figure 13:
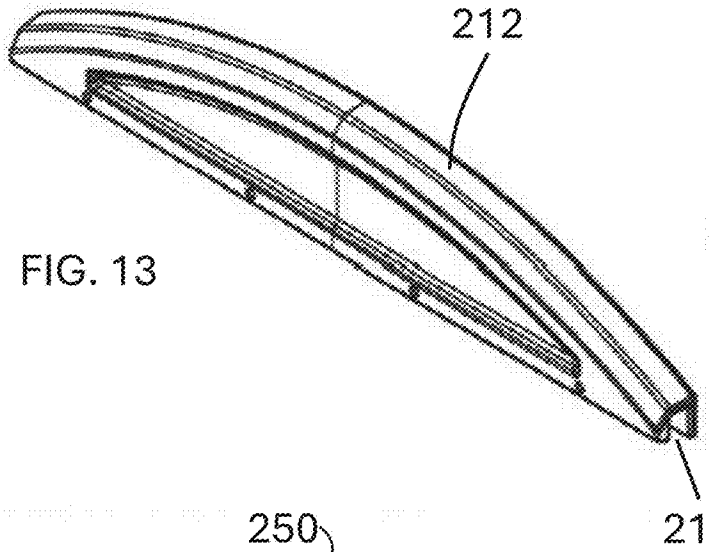
FIG. 13 is a front perspective view of the rail of FIG. 11 showing a lower channel of the rail that fits onto the rail mounting portion of the wall bunk.

Regarding FIG. 10, the rail mounting portion 150 includes an outer wall portion 200, an upper wall portion 202, and an inner wall portion 204 arranged to be received in a channel 210 of a rail 212 (see FIGS. 11 and 13) that is connected to the rail mounting portion 50.

Figure 11:
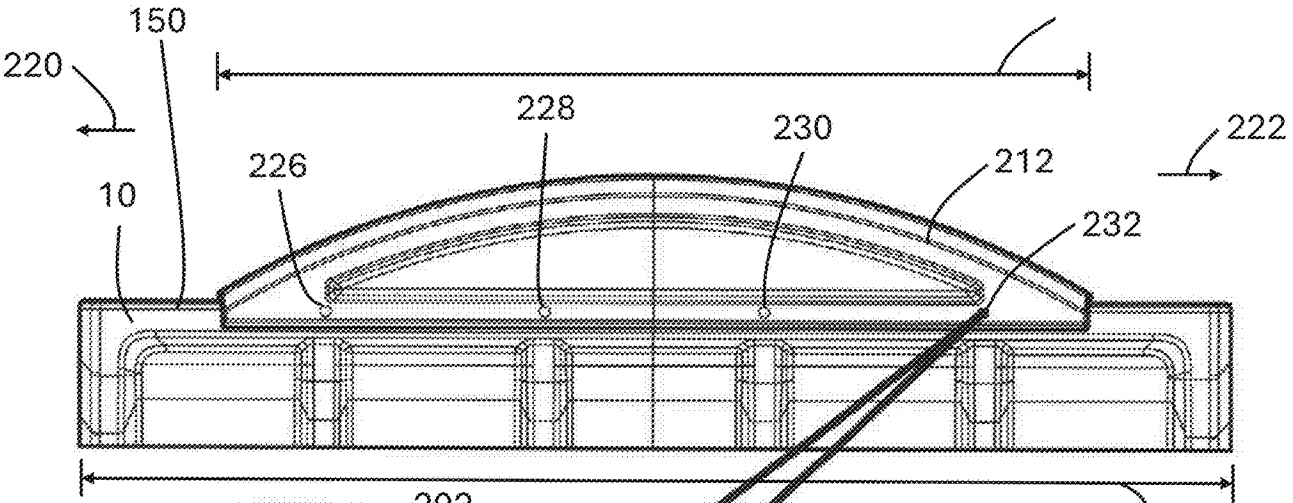
FIG. 11 is a front elevational view of a portion of the wall bunk of FIG. 1 with a longer rail mounted to the rail mounting portion.

Regarding FIG. 11, the rail 211 has a length 214 and may be shifted in directions 220, 222 prior to securing the rail 212 in position along the rail mounting portion 150. The rail 212 has four anchors 226, 228, 230, 232 for securing the rail 212 to the rail mounting portion 150.

Figure 12:
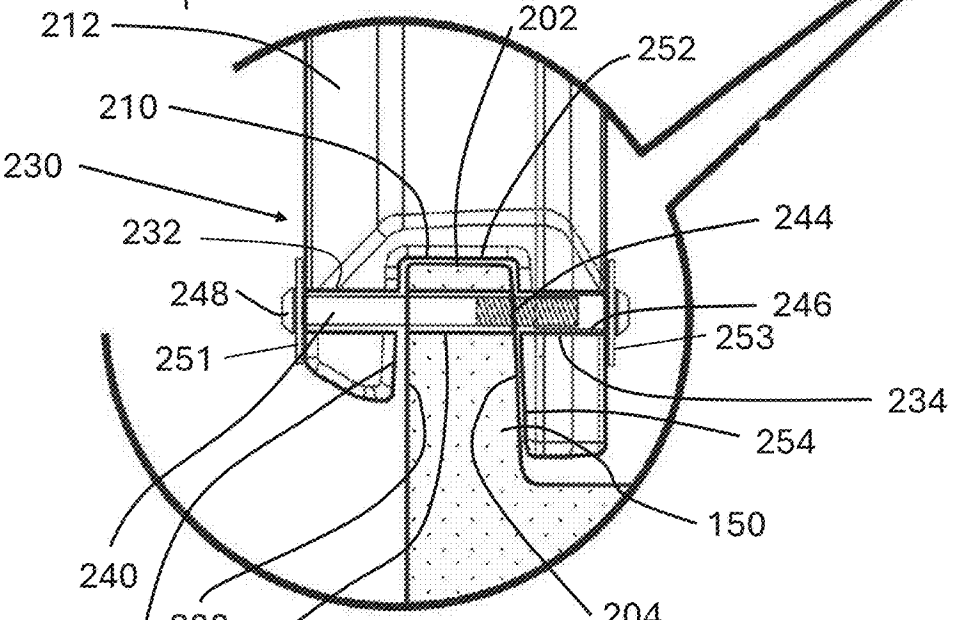
FIG. 12 is a cross-sectional view of an anchor connecting the rail and the wall bunk.

Regarding FIG. 12, in one embodiment, the rail 212 has a mounting portion 230 for each of the anchors 226, 228, 230, 232 that includes an outer through opening 232 and an inner through opening 234 that are to be positioned on opposite sides of the rail mounting portion 150 of the wall bunk 10. The inner and outer through openings 232, 234 are aligned with an intermediate through opening 236 of the rail mounting portion 150. An installer forms the intermediate through opening 236, such as by using a drill, at a position on the rail mounting portion 150 that corresponds to a desired location of the rail 212 along the rail mounting portion 150.

An installer advances the anchor, such as a bolt 240, to extend through the inner, intermediate, and outer through openings 230, 236, 234. The bolt 240 has threads 244 that are engaged with a binding barrel 246. The bolt 240 has a head portion 248 on an opposite side of the rail mounting portion 150 from the binding barrel 246. The installer tightens the bolt 240 into the binding barrel 246 to secure the rail 212 to the rail mounting portion 150. In one embodiment, washers 251, 253 are positioned between the head portion 248, the binding barrel 246, and rail 212.

Regarding FIG. 12, the mounting portion 230 of the rail 212 has wall portions 250, 252, 254 that complement the outer wall portion 200, upper wall portion 202, and inner wall portion 204 of the rail mounting portion 150. The bolt 240 extending in the through openings 232, 234, 236 and the engaged contact between the wall portions 250, 200 and 204, 254 resists deflection of the rail 212 out of the page in FIG. 11 such as a user of the wall bunk 10 attempting to roll out of the bunk.

Figure 14:
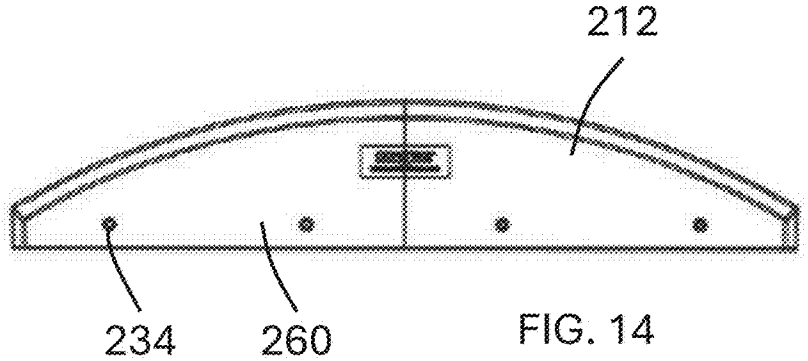
FIG. 14 is a rear elevational view of the rail of FIG. 11.
Figure 16:
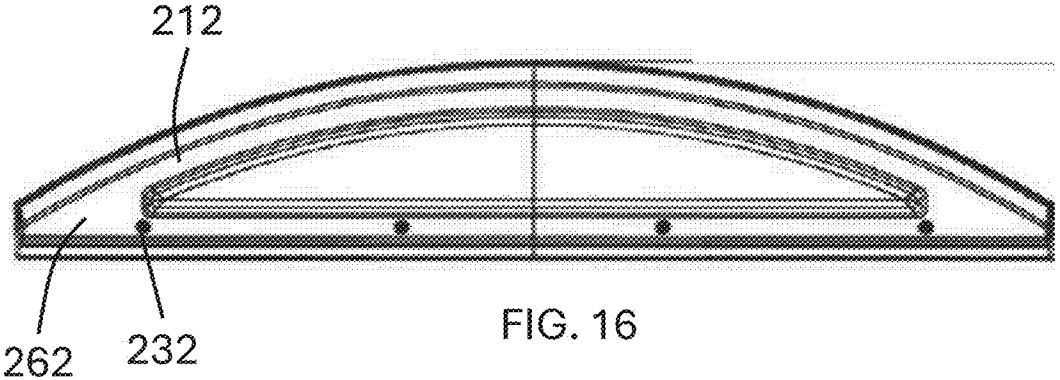
FIG. 16 is a front elevational view of the rail of FIG. 11 showing four through holes for receiving anchors.

Regarding FIGS. 14 and 16, the rail 212 has the inner through openings 234 on an inner side 260 of the rail 212 and the outer through openings 232 on an outer side 262 of the rail 212.

Figure 15:
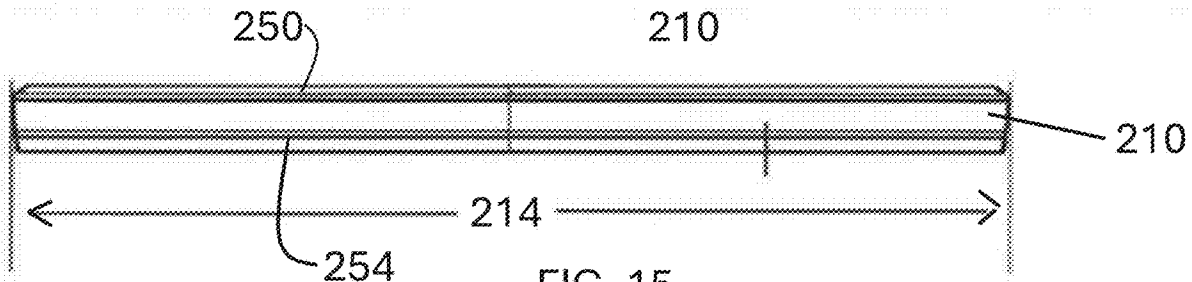
FIG. 15 is a bottom plan view of the rail of FIG. 11 showing the channel extending along the length of the rail.
Figure 17:
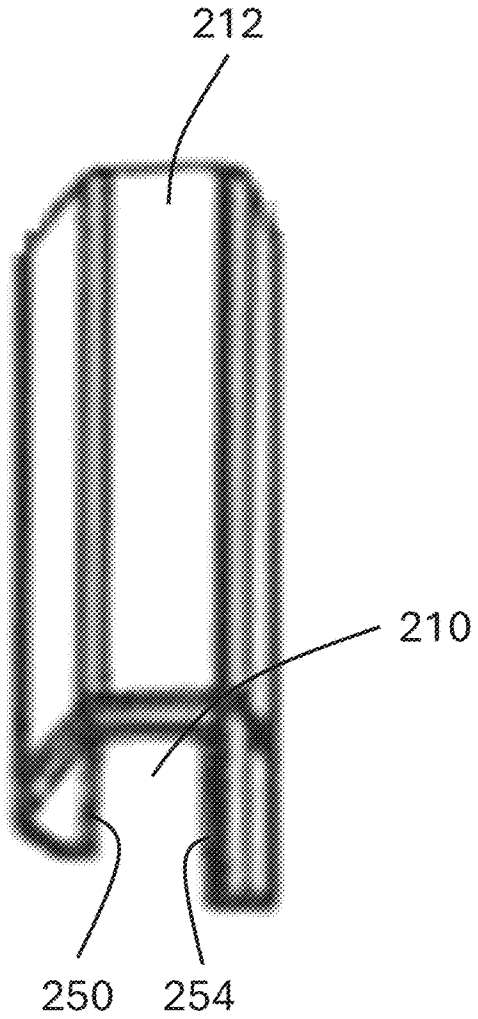
FIG. 17 is a side elevational view of the rail of FIG. 13 showing wall portions of the rail on opposite sides of the channel.

Regarding FIGS. 15 and 17, the wall portions 250, 254 extend along and define lateral sides of the channel 210. The channel 210 forms a slide connection with the rail mounting portion 150 that permits an installer to slide the rail 212 to a desired longitudinal position along the rail mounting portion, then mark the locations of the inner and outer through openings 232, 234 and form the intermediate through openings 236 at the marked locations.

Figure 18:
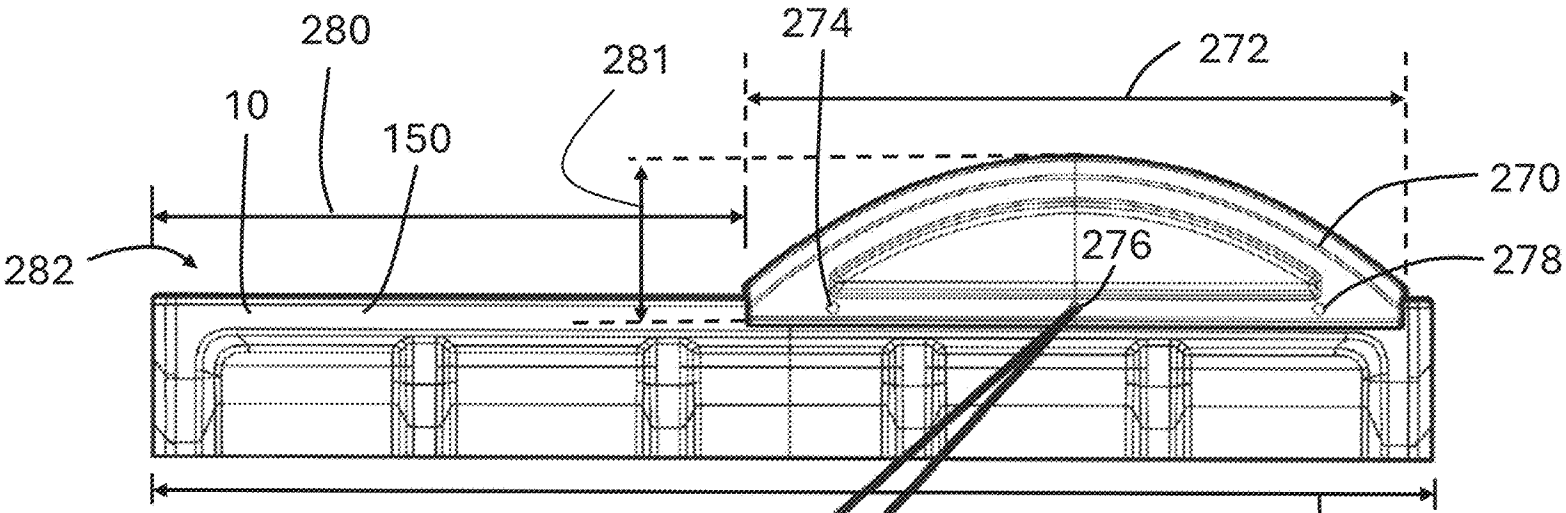
FIG. 18 is a front elevational view of a portion of the wall bunk of FIG. 1 having a shorter rail connected thereto.

Regarding FIG. 18, the wall bunk 10 may alternatively receive a rail 270 having a length 272 that is shorter than the length 214 of the rail 212. The length 272 of the rail 270 is approximately half of an overall length 216 of the rotationally-molded body 12 of the bunk 10. In this manner, there may be a longer length 280 of the rail mounting portion 150 that is uncovered by the rail 270 to provide an opening 282 for ingress and egress relative to the wall bunk 10. The uncovered length is at least 40% of the bunk body length 216 to provide an enlarged opening 282 for ingress and egress in generally lateral directions into and out of the bunk 10. In one embodiment, the rail length 272 is in the range of approximately 41 inches to approximately 43 inches, such as 42 inches; the bunk body length 216 is in the range of approximately 79 inches to approximately 82 inches, such as 80.6 inches; and the uncovered length 280 is in the range of approximately 37 inches to 41 inches, such as 38.6 inches. The uncovered length 280 may be the length of the rail mounting portion 150 minus the rail length 272. The uncovered length 280 may be the sum of two lengths of the rail mounting portion 150 on the left and right sides of the rail 270 in FIG. 18 that are uncovered by the rail 270.

The rail 270 is relatively compact while having a height 281 sized to resist unintended lateral movement of the occupant of the bed. Specifically, the length 272 of the rail 270 is less than four times the height 281 of the rail 270. In one embodiment, the length 272 is 42 inches and the height 281 is 12 inches.

Figure 19:
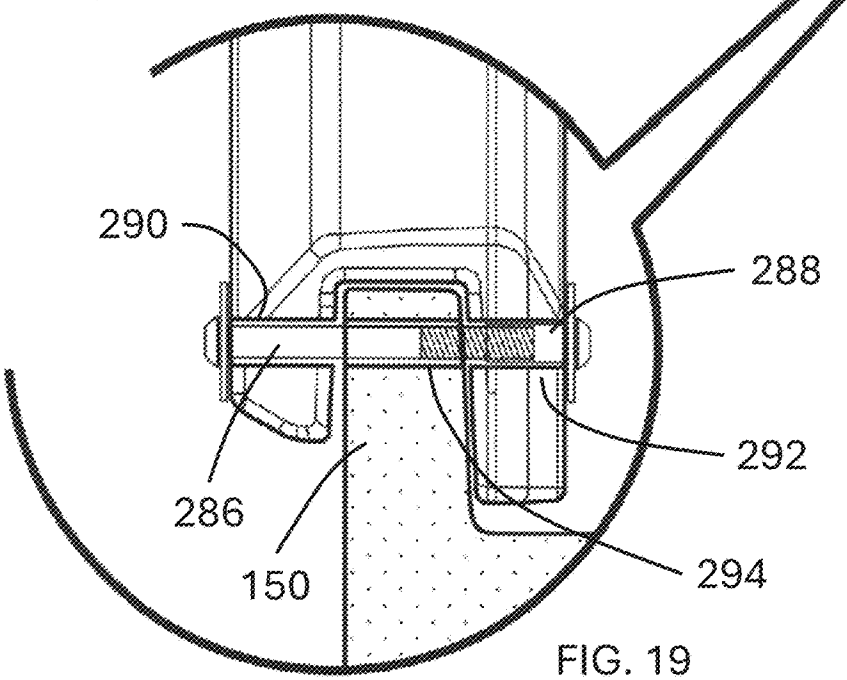
FIG. 19 is a cross-sectional view of an anchor securing the rail of FIG. 18 to the wall bunk.

Regarding FIG. 19, the rail 270 has only three through openings 292 to receive three anchors 274, 276, 278. Each of the anchors 274, 276, 278 may include a bolt 286 having a threaded shank that is engaged with a binding barrel 288. The bolt 286 extends through an outer through opening 290 of the rail 270, an inner through opening 292 of the rail 270, and an intermediate through opening 294 of the rail mounting portion 150.

Figure 20:
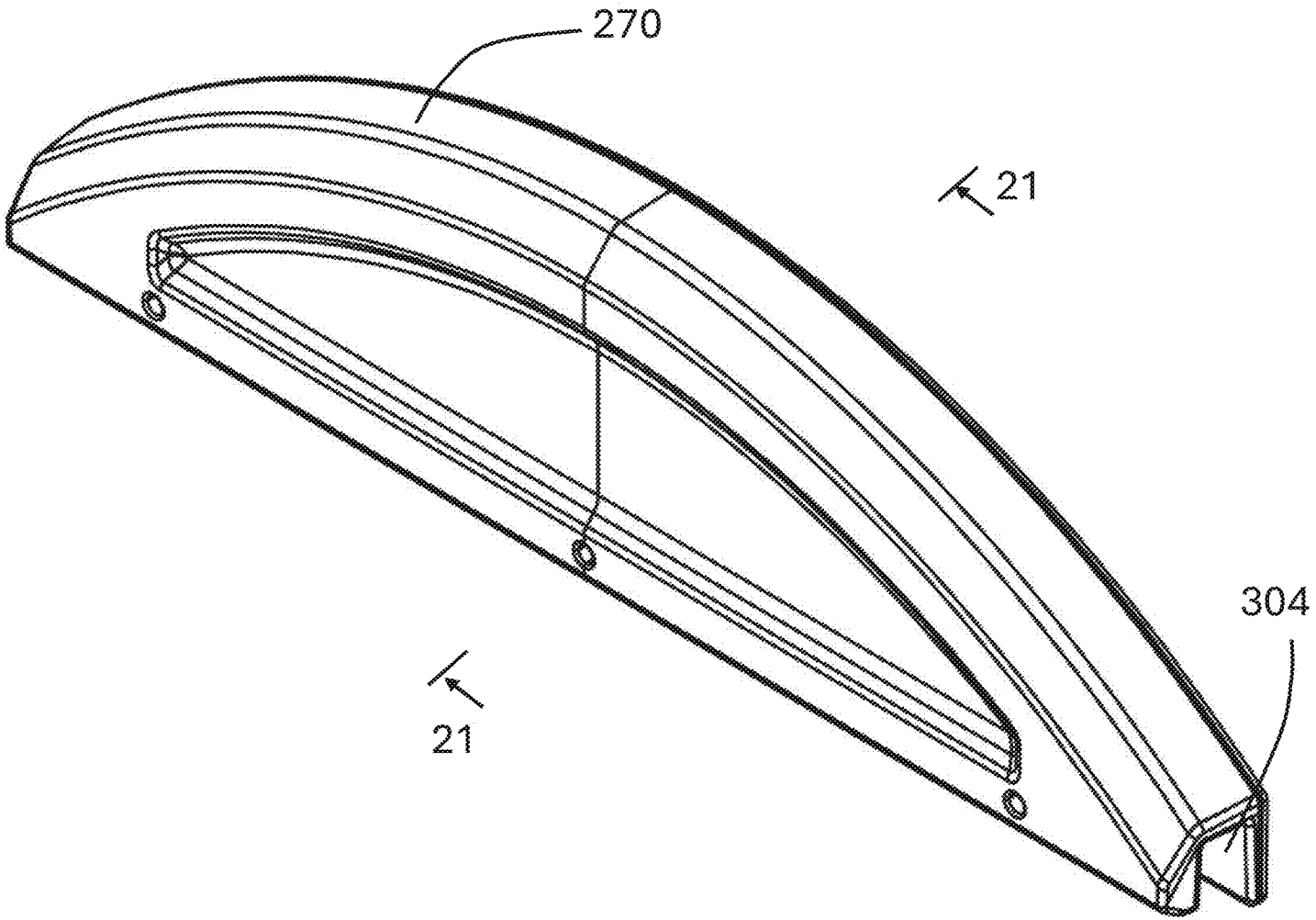
FIG. 20 is a perspective view of the rail of FIG. 18.
Figure 21:
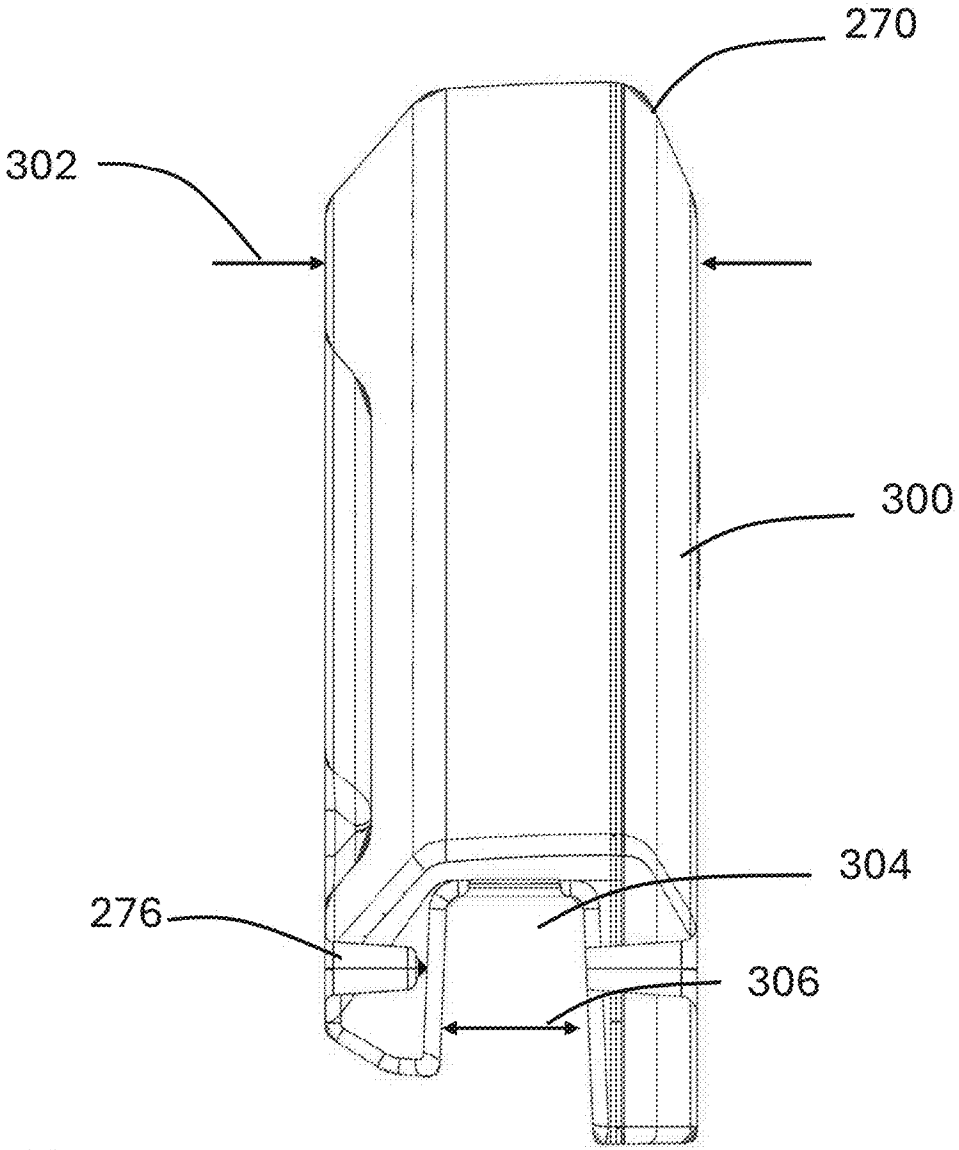
FIG. 21 is a cross-sectional view taken across the line 21-21 in FIG. 20.

Regarding FIGS. 20 and 21, the rail 270 is rotationally molded and has an interior 300 that contains air or structural foam. The rail 270 has an overall width 302, such as 4 inches, and a channel 304 with a width 306 sized to receive the rail mounting portion 150.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, it will be appreciated that numerous changes and modifications will occur to those skilled in the art, and it is intended for the present invention to cover all those changes and modifications which fall within the scope of the appended claims.

What is claimed is:

1. A wall bunk comprising: a rotationally molded elongate body, the body having an overall length; a mounting portion of the body; a bed pan of the body; a lower wall of the bed pan, the lower wall including a mattress support surface; curved wall portions of the lower wall at internal kiss-offs of the body; recesses in the mattress support surface defined at least in part by the curved wall portions for collecting moisture; a front wall of the bed pan; a rail configured to be connected to the front wall of the bed pan, the rail having a length and a height perpendicular to the height, wherein the length of the rail is less than four times the height of the rail; and an uncovered portion of the front wall of the bed pan with the rail connected to the front wall of the bed pan, the uncovered portion of the front wall having a length that is at least forty percent of the overall length of the body to provide a lateral opening for ingress and egress relative to the wall bunk; wherein the rail has at most three outer openings to be positioned on one side of the front wall and at most three inner openings to be positioned on an opposite side of the front wall, each one of the outer openings aligned with one of the inner openings to receive an anchor for extending through the front wall and connecting the rail to the body and wherein each of the recesses is circular and has a concave surface and a circular juncture between the concave surface and the mattress support surface, the circular juncture having a radius of curvature; and wherein the recesses each have a depth that is shorter than the radius of curvature of the circular juncture of the recess.

2. The wall bunk of claim 1 wherein the rail is rotationally molded and has an interior.

3. The wall bunk of claim 1 wherein the rail includes a channel configured to receive a rail mounting portion of the front wall of the bed pan.

4. The wall bunk of claim 1 wherein the recesses each have a recess length that extends along the length of the body and a recess width perpendicular to the recess length that is at least half of the recess length.

5. The wall bunk of claim 1 wherein the curved wall portion of each of the recesses curves inward from the mattress support surface with a radius of curvature; and wherein the recesses each have a depth that is shorter than the radius of curvature of the curved wall portion of the recess.

6. The wall bunk of claim 1 wherein the curved wall portions are each partially spherical.

7. The wall bunk of claim 1 wherein the bed pan has a central longitudinal axis;

wherein the recesses include groups of recesses, wherein each group comprises a pair of recesses aligned with the central longitudinal axis and another recess laterally offset from the central longitudinal axis.

8. The wall bunk of claim 1 wherein the mounting portion of the body includes a rear wall of the bed pan;

wherein the bed pan has a central longitudinal axis;

wherein the bed pan includes end walls extending intermediate the front and rear walls; and wherein the mattress support surface has a recess-free portion extending laterally from the central longitudinal axis to the rear wall and extending longitudinally between the end walls.

9. The wall bunk of claim 1 wherein the front wall has a rail mounting portion with a rail length extending parallel to the length of the body and a cross-section perpendicular to the rail length that is uniform for a majority of the rail length to permit the rail to be connected to the rail mounting portion and slid therealong.

10. The wall bunk of claim 1 wherein the rail and front wall of the bed pan are configured to form a slide connection therebetween that permits the rail to slide along the front wall.

11. The wall bunk of claim 1 wherein the mounting portion has six or fewer openings for receiving anchors to secure the wall bunk to a wall.

12. The wall bunk of claim 1 wherein the body is rotationally molded high-impact polyethylene.

13. The wall bunk of claim 1 wherein the body has an interior that contains air.

14. The wall bunk of claim 1 wherein the body has an interior that contains structural foam.

* * * * *